US009637279B2

(12) United States Patent
Schwartz et al.

(10) Patent No.: US 9,637,279 B2
(45) Date of Patent: May 2, 2017

(54) SAFETY CLOSURE FOR BEVERAGE CONTAINERS

(71) Applicant: Deutsche SiSi-Werke Betriebs GmbH, Eppelheim (DE)

(72) Inventors: Erhard Schwartz, Wiesloch (DE); Christopher Schmitt, Weinheim (DE)

(73) Assignee: DEUTSCHE SISI-WERKE BETRIEBS GMBH, Eppelheim (DE)

( * ) Notice: Subject to any disclaimer, the term of this patent is extended or adjusted under 35 U.S.C. 154(b) by 0 days.

(21) Appl. No.: 14/175,427

(22) Filed: Feb. 7, 2014

(65) Prior Publication Data

US 2014/0151375 A1 Jun. 5, 2014

Related U.S. Application Data

(63) Continuation of application No. 12/495,369, filed on Jun. 30, 2009, now abandoned.

(51) Int. Cl.

| | |
|---|---|
| ***A44B 13/00*** | (2006.01) |
| ***B65D 41/04*** | (2006.01) |
| ***B65D 51/24*** | (2006.01) |
| ***B65D 81/36*** | (2006.01) |
| *B65D 25/28* | (2006.01) |

(52) U.S. Cl.

CPC ..... *B65D 41/04* (2013.01); *B65D 51/242* (2013.01); *B65D 81/366* (2013.01); *B65D 25/28* (2013.01); *B65D 25/2802* (2013.01); *B65D 2213/00* (2013.01)

(58) Field of Classification Search

CPC .... B65D 41/04; B65D 51/242; B65D 81/366; B65D 2213/00

USPC .... 220/212.5, 269, 270, 288, 301, 315, 755, 220/752, 758, 759, 771, 773, 293, 375, 220/756; 222/466

See application file for complete search history.

(56) References Cited

U.S. PATENT DOCUMENTS

| | | | |
|---|---|---|---|
| 866,318 | A | 9/1907 | Wilson |
| 1,423,464 | A | 7/1922 | Shaw |
| 4,502,616 | A | 3/1985 | Meierhoefer |
| 4,512,475 | A | 4/1985 | Federighi |

(Continued)

FOREIGN PATENT DOCUMENTS

| | | | |
|---|---|---|---|
| DE | 102005028992 | A1 | 1/2007 |
| EP | 2033906 | A1 | 3/2009 |

(Continued)

OTHER PUBLICATIONS

English language translation of Office Action issued on Jul. 30, 2012 in Korean Patent Appln. No. 10-2010-0045951.

(Continued)

*Primary Examiner* — Fenn Mathew
*Assistant Examiner* — Elizabeth Volz
(74) *Attorney, Agent, or Firm* — Stroock & Stroock & Lavan LLP

(57) ABSTRACT

A safety closure for a beverage container that prevents an infant from ingesting the closure is provided. The closure includes a cylindrical cap body to be released securely into a beverage container. The cap body includes lateral projections extending from the cylindrical cap are sufficient to prevent an infant from ingesting the cap. The projections are provided to also facilitate rotation of the cap and to be releasably secure the cap of the container.

11 Claims, 2 Drawing Sheets

(56) References Cited

U.S. PATENT DOCUMENTS

| | | | | |
|---|---|---|---|---|
| 4,664,278 | A * | 5/1987 | Barriac | 215/252 |
| 4,792,060 | A | 12/1988 | Brogli | |
| 4,981,228 | A | 1/1991 | Kahn | |
| 5,184,740 | A | 2/1993 | Mandrell et al. | |
| 5,577,636 | A | 11/1996 | Fukuoka et al. | |
| 5,588,552 | A | 12/1996 | Johnson | |
| 5,908,124 | A * | 6/1999 | Klauke | B65D 1/0238 215/42 |
| 5,944,206 | A * | 8/1999 | Culter | B29C 49/4817 215/48 |
| D482,607 | S | 11/2003 | McRae | |
| 6,799,699 | B1 * | 10/2004 | LeMarr | B65D 35/22 222/129 |
| 6,874,665 | B2 | 4/2005 | Doherty et al. | |
| 6,991,140 | B2 * | 1/2006 | Bourque | B65D 47/148 215/48 |
| 7,540,389 | B2 | 6/2009 | Fontana | |
| D631,346 | S | 1/2011 | Schwartz et al. | |
| D638,720 | S | 5/2011 | Schwartz et al. | |
| 2003/0222047 | A1 * | 12/2003 | McRae | B65D 51/242 215/373 |
| 2004/0238564 | A1 | 12/2004 | Bourque et al. | |
| 2004/0250386 | A1 * | 12/2004 | Goldberg | 24/601.5 |
| 2007/0045313 | A1 * | 3/2007 | Holcomb | A47G 19/2272 222/469 |
| 2008/0041810 | A1 | 2/2008 | Itoh et al. | |
| 2010/0294773 | A1 | 11/2010 | Schwartz et al. | |

FOREIGN PATENT DOCUMENTS

| | | | | |
|---|---|---|---|---|
| FR | 1404567 | * | 7/1965 | B65D 51/24 |
| JP | 2006-526545 | A | 11/2006 | |
| KR | 10-2004-0096995 | A | 11/2004 | |
| KR | 10-2007-0045317 | A | 5/2007 | |
| WO | 99/57034 | | 11/1999 | |
| WO | 03/039985 | | 5/2003 | |
| WO | WO03039985 | * | 5/2003 | B65D 41/34 |

OTHER PUBLICATIONS

Search Report, dated Jun. 11, 2010, in European Patent Appln. No. 10163268.5, filed on May 19, 2010.

Office Action, dated Sep. 8, 2011, in Canadian Patent Appln. No. 2,701,415, filed on Apr. 26, 2010.

* cited by examiner

FIG. 1b
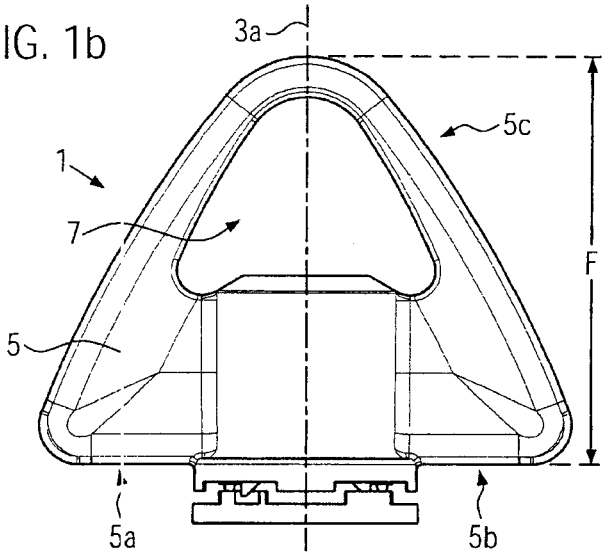
FIG. 1a
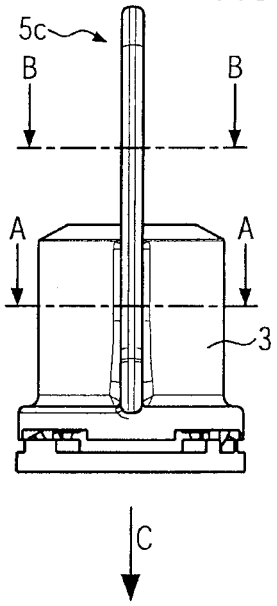
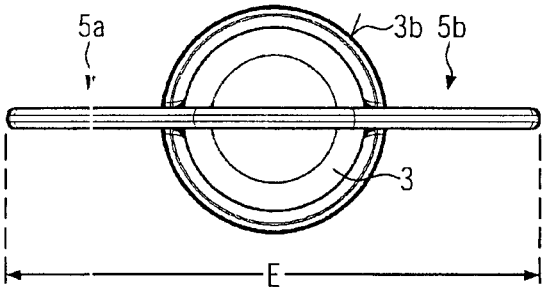
FIG. 1c
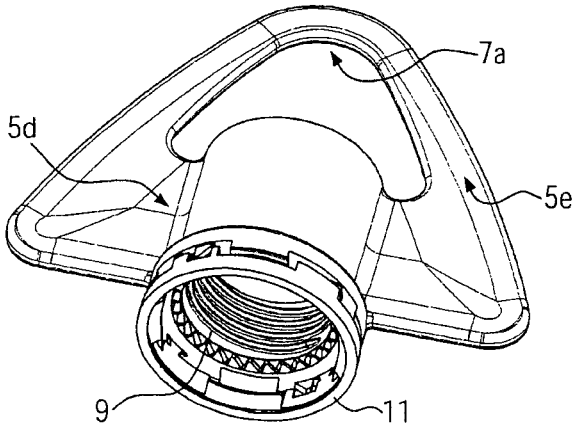
FIG. 2

SAFETY CLOSURE FOR BEVERAGE CONTAINERS

CROSS-REFERENCE TO RELATED APPLICATION

This application is a continuation of U.S. patent application Ser. No. 12/495,369, entitled SAFETY CLOSURE FOR BEVERAGE CONTAINERS, filed Jun. 30, 2009, which claims the benefit of German Application No. 202009007163.4 filed on May 19, 2009 the entire contents of both of which are incorporated herein by reference.

FIELD OF THE INVENTION

The present invention relates generally to a safety closure for a beverage container and in particular to a safety closure that includes lateral projections that facilitate rotation of the closure and also are configured to prevent an infant from ingesting the closure.

BACKGROUND OF THE INVENTION

Beverages are often stored in containers that have screw caps. When the beverage is consumed thereafter, the cap that is removed from the container is often left in the proximity of an infant. There is of course the risk of an infant ingesting the cap into his/her mouth. This is particularly a concern when the beverage in the container is one that is targeted toward children and infants. Since the dimensions of most conventional closures are only insignificantly larger in diameter when compared to the respective opening in the container, the size of most conventional bottle caps would make them ingestible by an infant. Accordingly, a bottle closure that would avoid the risk of ingestion would be desirable.

SUMMARY OF INVENTION

Generally speaking, in accordance with the invention, a safety closure for a beverage container that would prevent an infant from ingesting the cap is provided. The closure includes a cylindrical cap body that is adapted to be releasably secured to a beverage container. At least one lateral projection extends from the cylindrical cap and is of a sufficient length to prevent an infant from ingesting the cap and also facilitates rotation of the cap to releasably secure the cap to the container. In a preferred embodiment, the lateral projections face inn opposite direction and are aligned with each other and are of sufficient dimension to prevent an infant from ingesting the safety closure.

Accordingly, it is an object of this invention to provide an improved safety closure that prevents infants from ingesting the cap.

It is a further object of the instant invention to provide a safety closure that prevents ingestion by an infant for use in containers that have food products.

It is still a further object of the instant invention to have lateral projections that are sufficiently dimensioned to infants' anatomy to prevent a health hazard caused by swallowing.

It is a further object of the invention to provide a closure cap that has an ergonomic configuration that is for use with a flat container pouch that can store beverages and that permits a high packing density.

It is a further object of the invention to provide a safety closure that includes projections that form an opening for saving material and for permitting the opening to receive a fastener or be supported on a post.

Additional features and advantages of the present invention is described further below. This summary section is meant merely to illustrate certain features of the invention. It is not meant to limit the scope of the invention in any way. The failure to discuss a specific feature or embodiment of the invention or the inclusion of one or more features in this summary section not be construed to limit the invention claimed.

BRIEF DESCRIPTION OF THE DRAWING

The foregoing summary as well as the following detailed description of the preferred embodiments of the application will be better understood when read in conjunction with the appended drawings. For purposes of illustrating the device of the present application there is shown in the drawings preferred embodiments. It should be understood, however, that the application is not limited to the precise arrangements and instrumentality shown. In the drawings FIG. 1*a* is the side elevational view of a safety closure cap constructed in accordance with the instant invention;

FIG. 1*b* is a front elevational view of a safety closure in accordance with a preferred embodiment of the instant invention;

FIG. 1*c* is a top view of the safety closure of the preferred embodiment of the instant invention;

FIG. 2 is a perspective view of the safety closure constructed in accordance with the preferred embodiment of the instant invention;

DETAILED DESCRIPTION OF THE PREFERRED EMBODIMENT

Figure 3:
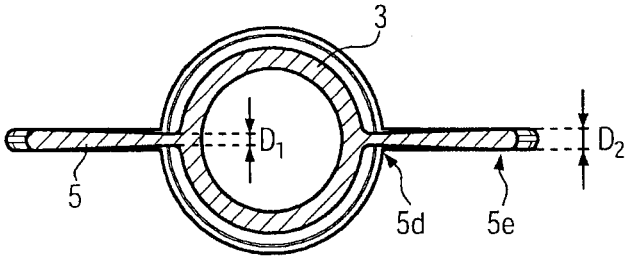
FIG. 3 is a sectional view taken along line A-A of FIG. 1*a*.

Reference is made to FIGS. 1, 1*a*, 1*b* and 1*c* wherein a safety closure cap, generally indicated at 1 that is constructed in accordance with a preferred embodiment of the invention is depicted. Safety closure cap 1 includes a substantially cylindrical cap 3 and a lateral wing generally indicated as 5 which is symmetrical relative to the central axis 3*a* of the cap 3. Wing 5 includes lateral projections 5*a* and 5*b* which are diametrically opposed and are aligned with one another. Lateral projections 5*a* and 5*b* are connected by a tab shaped section 5*c* and together define an opening 7.

As will be discussed in greater detail with respect to FIG. 2, the basic body cap 3 has an internal thread 9 so that the closure can be screwed on to the external thread of a container opening (not shown). Furthermore a conventional safety lock 11 can be provided on the body cap. The lock primarily insures that a closed container has not been previously opened and is provided for safety purposes.

Reference is specifically made to FIG. 3 wherein the cross section of the wing 5 is depicted. The thickness of the wing construction is configured to increase outwardly from a minimal thickness $D_1$ with a central transmission region 5*d* at the cylindrical wall of cap body 3 to a maximum thickness $D_2$ in the surrounding outer edge region 5*e* of the wing 5. This configuration is easy to grip so that the fingers, particularly those of infant, will slide off less easily on operation of the cap. Moreover, the thicker end region 5*e* prevents a situation where the closing cap 3 that are often stored in bulk and are separated during manufacture get wedged together, because the thickness $D_2$ is larger than the width of the gap formed between the basic cap body 3 and the safety lock 11. Accordingly, you obtain the benefit of saving material when forming the wing 5 and at the same time the wing cannot get wedged in the gap of another closure cap.

Figure 4:
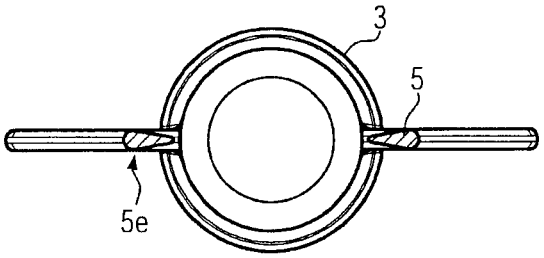
FIG. 4 is a sectional view along line B-B of FIG. 1*a*.

Reference is made to FIG. 4 wherein the cross section of wing 5 at the level of the aperture 7 is depicted. As depicted therein, cross section of the wing 5 has a maximum thickness $D_2$ which provides a bead-like outer region 5*e* decreasing as it extends toward the opening 7. This decreasing thickness helps to save material while ensuring an adequate stiffness for the wing 5.

By using this configuration where the thickness of the wing decreased from its outer periphery as it extends inwardly toward the opening 7, material used to manufacture the product is saved on the one hand and an opening is provided on the other hand to permit a suspended hook to support the closing cap or a container with the cap screwed on. Such a closure is particularly suitable for flexible foil pouches that are used to store fruit beverages and other food products. This closure configuration will facilitate sales of the product as well as storage and transportation and handling by the consumer. In an exemplary embodiment opening 7 is preferably centrally arranged above the basic cap body 3 to facilitate balanced suspended storage particularly desirable of the upper region 7*a* (FIG. 2) of the opening, which during storage will likely rest on a fastening hook.

It is however recognized that despite the advantages described above, it is within the scope of the invention to form the wing 5 without any recess, without a symmetrical opening or with a plurality of openings. Similarly, the reduction of the thickness of the wing as it extends towards the aperture is not a requirement of the invention but does provide certain benefits which have already been described above.

As illustrated in FIG. 1B in an exemplary embodiment, the shape of the closure 1, and in particular that of wing 5 corresponds to an isosceles triangle with rounded off edges (on the bottom side of the wing 5, the container side) and a parabolic arc with the vertex at the top. An essential triangle shape of the wing has the advantage that the anti-ingestion protection afforded by the closing cap is independent of the special orientation thereof. Moreover this benefit is accomplished with a relatively small amount of material used to form the wing.

In a preferred embodiment the width E and height F of this substantially triangle shape are preferably 2.5 centimeters to 6 centimeters. In an exemplary embodiment of the invention, in order to provide even a greater safety factor, the dimensions are within a range of 3 centimeters to 6 centimeters.

In an alternative embodiment of the invention, the shape of the closing cap can be adapted to a particular container shape in order to obtain the particularly advantageous ergonomic shape. For example, the wing need not be in symmetry with the main axis 3*a* the basic cap body 3. Rather, there could be a projection at one side or at both sides of a container. Similarly, the shape and size ratio of the lateral wing sections 5*a* and 5*b* and of the tab section 5*c* may differ from the embodiment. For example, the opening 7 can be smaller, the tab shaped section could be thicker. It is however within the scope of the instant invention that the closing cap 1 should be configured to address an infant's anatomy so that swallowing or ingestion is reliably prevented.

Although the invention is suitable for use with large containers with wide openings and large closing caps, it is particularly important in the case of small containers to provide a large closing cap. The ingestion proof closing cap of the instant invention is therefore particularly advantageous for containers with contents of up to 1 liter and in particular with containers of contents of 500 millimeters and very popular for containers with contents of up to 330 ml. Moreover the ratio of container volume to the volume of the closing cap defined by the latter contours thereof if preferably 50 to 1 and in an exemplary embodiment 10 to 2. The ratio of a maximum dimension of an associated container such as the height thereof to the width E and/or height F the wing 6 is preferably 10 to 1 and in an exemplary embodiment 7 to 2. Moreover, in another embodiment, advantages of the invention are ergonomically obtained by a ratio of 4 to 2.

In the embodiment depicted in FIGS. 1*a*, 1*b* and 1*c*, the wing is substantially triangular shaped so that the lateral regions are substantially in alignment with each other and/or are aligned in a plane. This is particularly advantageous when utilized with flat beverage bags not only from the viewpoint of the ergonomic standpoint but also from the standpoint of packaging technology. However, depending on the particular shape of a container, the instant invention also contemplates that the lateral wing sections 5*a* and 5*b* do not need to be in alignment with one another and that several wings can be contemplated, for example, where the wings are orthogonally oriented relatively to one another (not shown) and are mounted on one particular closing cap body 3. In such an embodiment, it is important that the shape of the closure cap prevents swallowing by children, and particularly by infants.

Similarly, although the closing cap assembly can be provided for an upright or suspended container with an opening provided topside thereof such as a flat bag, the instant invention is not limited thereto. In an alternative embodiment the closing cap could also be used with a lateral container opening or a container opening at the bottom of the bag, as long as lateral dimensions are selected to prevent ingestion by an infant.

The instant invention is particularly desirable for screw caps. However it could also be used for other caps. For example, bayonet caps, clamp caps or push-pull caps. A closing cap according to the invention would also provide a benefit if it has been fastened to a container and is detached therefrom for example, after improper use.

The closing cap of the instant invention is preferably made from an elastic sealing material such as polyethylene (PE), polypropylene (PP), a PP copolymer, a PP-PE copolymer or a PP-PE blend. Depending on the intended use, and in particular the beverage stored therein, polyamide, acrylonitrile butadiene styrene and polyoxymethylene are suited as materials for use in the closing cap.

When used with food containers the closing cap 1 must satisfy the relevant provisions and must in this case be made from materials recognized to be safe for food products. However, the closing cap in the instant invention is not limited to food products. For example, it can also be used for containers storing products, for body care, domestic and technical applications, such as soaps, rinsing agents and adhesive. Accordingly, a swallow proof closing cap which is made from biodegradable material might also be appropriate given the environmentally friendly concerns that are now present. Finally, the closing cap of the instant invention is particularly suited for containers in which liquids or pourable substances are stored or transported and reliably prevents the situation where the infant might swallow or ingest the closing cap.

It will be appreciated by those skilled in the art that the figures are purely illustrative and that the device may be implemented in any number of ways as long as the functionality is retained.

What is claimed is:

1. A safety closure comprising:

a cylindrical cap body of a screw type or bayonet type, having a cylindrical wall and a central axis, that is adapted to be releasably secured to a beverage container; and a lateral wing comprising:

at least two lateral projections extending from the cylindrical wall of the cap body along its height, which are diametrically opposed and are aligned with one another in a plane substantially parallel to the central axis of the cap body; and a tab section connecting the at least two lateral projections to define an opening above the cap body that is adapted to receive a fastener or be supported on a post, wherein the thickness of the tab section decreases from its outer periphery as it extends inwardly toward the opening, and wherein the safety closure has a width and a height within a range of 2.5 cm to 6 cm to prevent an infant from swallowing the closure.

2. A safety closure as claimed in claim 1, wherein the at least two lateral projections are symmetrical with respect to each other.

3. A safety closure as claimed in claim 1, wherein the opening is centrally arranged above the cap body.

4. A safety closure as claimed in claim 1, wherein the opening is symmetrical relative to the central axis of the cap body.

5. A safety closure as claimed in claim 1, wherein the thickness of each lateral projection increases as the lateral projection extends outwardly from the cylindrical wall of the cap body.

6. A safety closure as claimed in claim 1, wherein the shape of the safety closure corresponds to an isosceles triangle with rounded edges.

7. A safety closure as claimed in claim 1, wherein the safety closure has a substantially triangular shape having a width and a height within a range of 3 cm to 6 cm.

8. A safety closure as claimed in claim 1, wherein the cap body includes an internal thread to permit the cap to be screwed on to an external thread on the container.

9. A safety closure as claimed in claim 1, wherein the safety closure is made from a polymer selected from the group consisting of polyethylene (PE), polypropylene (PP), a polypropylene (PP) copolymer, a polypropylene-polyethylene (PP-PE) copolymer and a polypropylene-polyethylene (PP-PE) blend.

10. A safety closure as claimed in claim 1, wherein the safety closure is made from a biodegradable material.

11. A safety closure as claimed in claim 1, wherein the cap body includes a locking mechanism.

* * * * *